United States Patent [19]

Anderson

[11] Patent Number: 4,667,565

[45] Date of Patent: May 26, 1987

[54] RAPID RESPONSE PATROL AND ANTITERRORIST VEHICLE

[75] Inventor: Reg A. Anderson, Dallas, Tex.

[73] Assignee: Tetradyne Corporation, Farmers Branch, Tex.

[21] Appl. No.: 681,945

[22] Filed: Dec. 14, 1984

[51] Int. Cl.[4] ..... F41D 11/24; F41F 23/02

[52] U.S. Cl. ..... 89/36.08; 89/37.03; 89/38; 89/40.03

[58] Field of Search ..... 89/1.1, 28.05, 36.08, 89/37.03, 38, 40.03

[56] References Cited

U.S. PATENT DOCUMENTS

| | | | |
|---|---|---|---|
| 1,351,383 | 8/1920 | Hitt | 89/38 |
| 1,800,276 | 4/1931 | Baker | 89/40.03 |
| 1,928,306 | 9/1933 | Brennan | 89/36.08 |
| 3,333,507 | 8/1967 | Meiss | 89/36.13 |
| 3,424,052 | 1/1969 | Ruf | 89/37.01 |
| 4,039,222 | 8/1977 | Wolf et al. | 296/222 |
| 4,065,999 | 1/1978 | Hultgren | 89/36.08 |

*Primary Examiner*—John F. Terapane
*Assistant Examiner*—Eric Jorgensen
*Attorney, Agent, or Firm*—Richards, Harris, Medlock & Andrews

[57] ABSTRACT

A rapid response patrol and antiterrorist vehicle (10) is disclosed which incorporates a weapon such as a machine gun (16) which can be extended through a roof opening of the vehicle (10) to control terrorist activity. However, when the weapon is in the storage position, the vehicle (10) has a totally conventional appearance.

When the gun is to be used, the roof hatch (15) is retracted by a hydraulic motor (150) and is retracted into a space between a conventional appearing roof section (128) and an inner armored roof section (126). The weapon can then be raised on a pivotal weapon frame (18) which is activated by a rotary hydraulic motor (29). The pivotal weapon frame (18) can be securely fastened to a stationary support frame (22) within the vehicle by activating a locking pin (122). The control system prevents the pivotal weapon frame (18) from pivoting from its storage position to the firing position before the roof hatch (15) is fully retracted. In addition, the control system indicates to the operator that the locking pin (122) has locked the pivotal weapon frame (18) to the stationary support frame (22) to provide a stable platform for firing of the weapon. Also, the roof hatch mechanism can be used without weapons or armor for any desired purpose.

11 Claims, 14 Drawing Figures

RAPID RESPONSE PATROL AND ANTITERRORIST VEHICLE

TECHNICAL FIELD

This invention relates to a vehicle for patrol and for use in protection against terrorism or other violent action. The vehicle can be equipped with a weapon, such as a machine gun, which can be fully concealed within the vehicle so that the vehicle has a conventional appearance.

BACKGROUND ART

The activities of terrorists are a well-known and recognized problem throughout the world. To combat this crisis, businesses, individuals and even governments have been developing deterrants. When a large facility is to be guarded, it is impossible to adequately perform this task by simply having stationary guard stations. Therefore, vehicles are used which are in constant radio communication with a central dispatching unit which can rapidly respond to an indication of trouble at a particular point in the perimeter.

In the past, these rapid response vehicles have usually comprised common every day vehicles, such as a jeep or other four-wheel drive vehicle. As the threat and fact of terrorism has become more serious, a need has arisen to provide armor on such rapid response vehicles to protect the occupants. Furthermore, it has been recognized that heavier weaponry may be needed than can be carried by a guard. This has given rise to the desire to mount a weapon, such as a machine gun, on the rapid response vehicle itself.

Apart from protection from terrorism, there is a strong feeling, particularly on the part of governments, to avoid the appearance of a warlike status that would be given by having a conventional armored vehicle with permanently mounted exposed weaponry. One reason for this concern is to avoid the psychological intimidation and fear that affects the public at large by seeing such warlike vehicles. Another concern is the lack of concealment of defense response in a conventional armored vehicle. A terrorist need only look at the vehicle to know precisely what weapons he must face.

Therefore, a need has arisen for a rapid response vehicle which is capable of carrying the necessary weaponry, such as a machine gun. However, at all times except when repelling terrorist attack, the vehicle should have the appearance of a conventional vehicle, without any weaponry being exposed on the exterior of the vehicle. However, the vehicle must be capable of rapidly transforming itself from a conventional appearing vehicle to one with its weaponry exposed for virtually instantaneous use when defending against a terrorist attack. Furthermore, a need also exists for a rapid response vehicle of conventional appearance for other patrol activities, such as the movement of troops. This vehicle may be armored, or not as the need arises.

SUMMARY OF THE INVENTION

In accordance with one aspect of the present invention, a weapon system for a vehicle is disclosed. The vehicle includes an interior platform and a roof. The roof is formed of two sections, an interior armored section and an exterior conventional appearing section. A roof opening is formed through both sections. A pivotal weapon frame is pivotally attached to the interior platform for pivotal motion between a storage position and a firing position. A weapon support ring assembly is pivotally secured to the pivotal weapon frame so that the weapon support ring assembly is horizontal and positioned in the roof opening when the pivotal weapon frame is pivoted to the firing position. The weapon support ring assembly includes a stationary ring pivoted to the pivotal weapon frame. The stationary ring has an inner cylindrical surface with a ball race formed therein. The weapon support ring assembly further includes a movable ring which has an outer cylindrical surface of slightly smaller diameter than the inner cylindrical surface of the stationary ring and also has a ball race formed therein. The movable ring nests within the stationary ring with the cylindrical surfaces facing. A plurality of ball bearings are positioned between the rings, running in the races to support the movable ring on the stationary ring and permit the movable ring to rotate freely in a generally horizontal plane relative to the stationary ring. Structure is provided on the movable ring to mount a weapon, such as a machine gun. Structure is also provided for locking the movable ring relative to the stationary ring to form a rigid platform for the weapon.

A roof hatch assembly is provided for closing the opening through the roof to conceal the weapon and protect the interior of the vehicle. The roof hatch assembly includes an armored roof hatch. Parallel guide rods are mounted on the armored section of the vehicle roof and extend along opposite sides of the roof opening, the guide rods sloping downward from the plane of the roof opening. Structure is provided for supporting the armored roof hatch on the guide rods for free motion along the guide rods. The guide rods have sufficient length so that the armored roof hatch can be retracted into the space between the conventional roof section and the armored roof section and out of the roof opening to permit use of the weapon. A rotary screw is mounted on the armored roof for rotation about an axis generally parallel the guide rods. Structure is provided for rotating the rotary screw in either direction. A bracket assembly is provided which includes a traversing member with an internal thread for engaging the thread on the rotary screw. A bracket is mounted on the roof hatch and a lifting link is pivoted between the bracket and the traversing member. Rotation of the rotary screw causes the traversing member to move along the rotary screw, the traversing member moving the roof hatch along the guide rods through the lifting link and the bracket. Rotation of the rotary screw therefore permits the armored roof hatch to be moved between the retracted position and the position closing the roof opening. The structure supporting the roof hatch on the guide rod permits limited movement of the roof hatch away from the guide rods. Because the guide rods are sloped relative to the roof opening, as the roof hatch is moved to close the roof opening, one edge of the roof hatch will contact the edge of the conventional roof section. Further rotation of the rotary screw will cause the lifting link to pivot about the traversing member and the bracket and lift the other end of the roof hatch to close the roof opening. Rotation of the rotary screw in the opposite direction will pivot the lifting link to lower the end of the roof hatch and permit it to move to the retracted position. A spring can be employed to bias the lifting link so that the roof hatch is lowered to prevent lifting of the roof hatch as it moves along the guides.

Control apparatus is provided for controlling the relative movements of the pivotal weapon frame and the roof hatch assembly. The apparatus prevents the pivotal weapon frame from pivoting from the storage position to the firing position before the roof hatch has been moved to the retracted position.

In accordance with another aspect of the present invention, a stationary support frame is provided which has first support members extending from the interior platform to a first position proximate the roof at the roof opening. A second support member extends horizontally forward from the first position proximate the interior of the roof and to the top of the windshield. Windshield support members extend along the top of the windshield and down the center of the windshield to the dashboard and are secured to the second support member. The support frame at the first position forms a receptacle for an indexing pin extending from the stationary ring of the weapon support ring assembly. The indexing pin enters the receptacle on the stationary support frame when the pivotal weapon frame is in the firing position. Structure is provided for locking the indexing pin within the receptacle to provide a rigid support for the weapon.

In accordance with another aspect of the present invention, the weapon support ring mounts a permanent armor shield on the stationary ring and a plurality of pivotal armor sections which pivot into the protecting position as the weapon operator moves into position for use of the weapon.

In accordance with another aspect of the invention, the roof hatch mechanism can be used for purposes other than an armored weapon carrier, such as troop transport. Further, the weapon elevating devices and roof hatch mechanism of the present invention can be used in a non-armored vehicle.

BRIEF DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
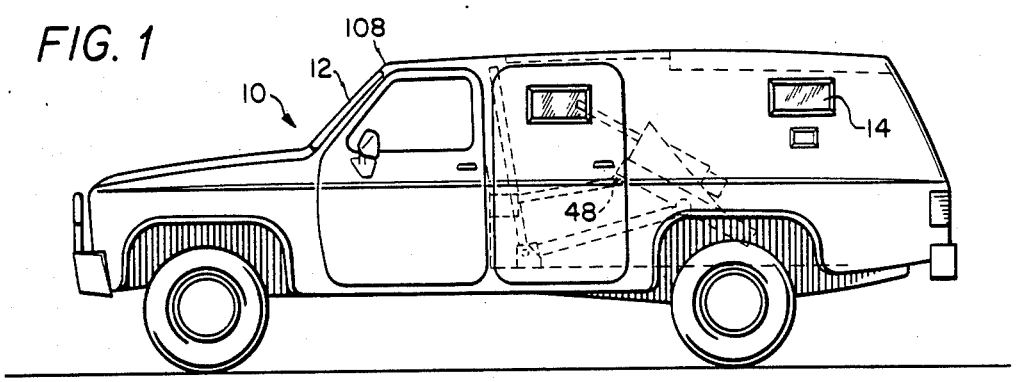
FIG. 1 is a cross-sectional view of the rapid response vehicle illustrating the weapon in the storage position and the roof hatch closing the opening in the roof.
Figure 2:
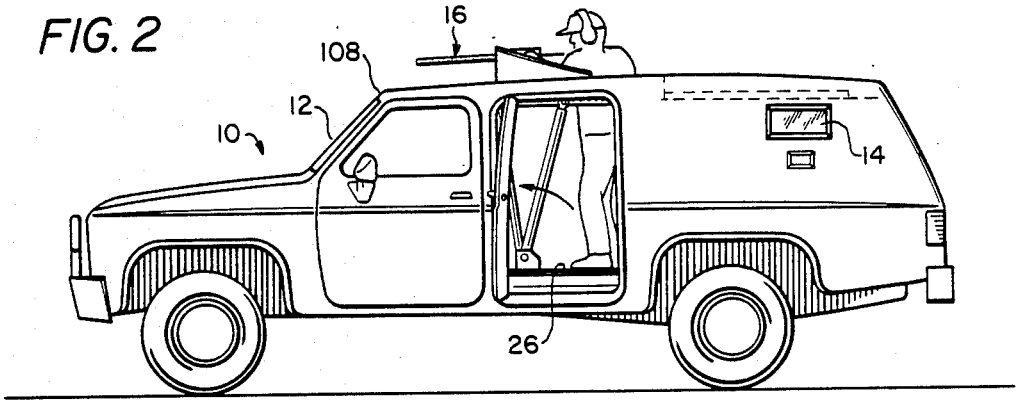
FIG. 2 is a cross-sectional view of the rapid response vehicle illustrating the weapon in firing position and the roof hatch in the retracted position.

Referring now to the Drawings, wherein like reference characters designate like or corresponding parts throughout several views, FIGS. 1 and 2 illustrate a rapid response vehicle 10. The vehicle 10 has full armor, including the sides, floor and roof, as well an armored windshield 12 and several armored windows 14. However, it will be understood that the present invention can be employed in a nonarmored vehicle, if desired. The vehicle 10 mounts a weapon, such as the machine gun 16 which can be stored within the vehicle in a retracted position, but moved to the firing position through an opening in the roof as seen in FIG. 2 when needed. Roof hatch 15 normally closes the roof opening, but can be retracted to allow use of gun 16. As can be seen by reference to FIG. 1, when the gun 16 is in the storage position, there is no external indication of the nature of the vehicle. Thus, the true nature of the vehicle is disguised as desired.

Figure 3:
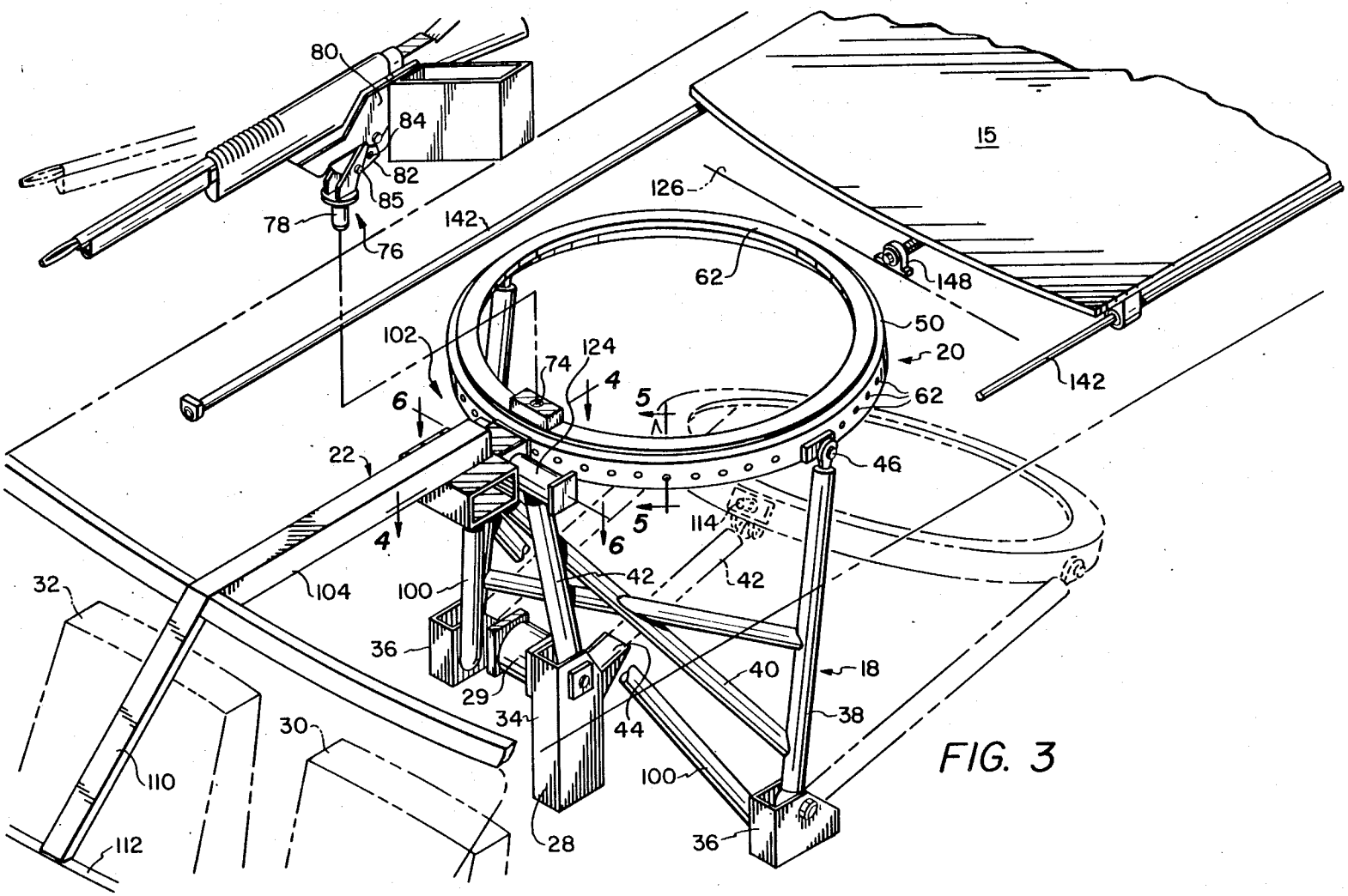
FIG. 3 is a perspective view of the pivotal weapon frame and stationary support frame for supporting the weapon in the firing position.

With reference now to FIG. 3 as well, the mechanism for moving the gun 16 between a storage and firing position is better illustrated. The vehicle 10 includes a pivotal weapon frame 18, a weapon support ring assembly 20 and a stationary support frame 22. The pivotal weapon frame 18 will pivot between the storage position, shown in FIG. 1, and the firing position, shown in FIG. 2. When in the firing position, the pivotal weapon frame 18 is secured to the stationary support frame 22 to provide an enhanced support to form a stationary platform for the machine gun 16 despite the recoil of the gun during firing. The weapon support ring assembly 20 actually supports the gun 16 and is provided with a movable ring 64 which can rotate in a horizontal plane to permit the gun to be rotated a full 360°.

The pivotal weapon frame 18 is pivoted to the floor 26 of the vehicle 10. The floor 26 can be the stock floor as provided by the manufacturer or can be reinforced as needed to support the frame 18. A support pedestal 28 extends upward from the floor 26 between and immediately behind the drivers seat 30 and passenger seat 32. A rotary hydraulic actuator 29 is mounted on pedestal 28 to raise and lower frame 18. A clevis 34 is mounted on top of the support pedestal 28. Clevises 36 are mounted on either side of the support pedestal and further back in the vehicle at the floor 26.

The frame 18 includes rear legs 38, each of which is pivotally attached to a clevis 36. Cross members 40 rigidly interconnect the rear legs 38. The weapon support ring assembly 20 is pivotally secured between the upper ends of the rear legs 38 as described hereinafter. The frame 18 further includes a front leg 42 which is pivoted to the clevis 34 and secured to motor 29 for pivotal motion, and extends to the front of the weapon support ring assembly 20 at its forward end. The pivotal weapon frame 18 can therefore be pivoted between the storage position, shown in FIG. 1, where the front leg 42 rests against a stop 44 on the support pedestal 28, and the firing position shown in FIG. 2.

Figure 4:
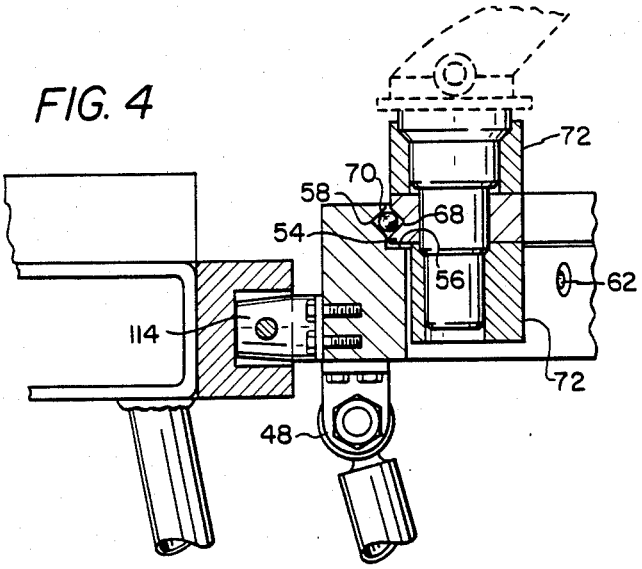
FIG. 4 is a cross section of the weapon support ring assembly taken along line 4—4 in FIG. 3 illustrating the weapon mount.
Figure 5:
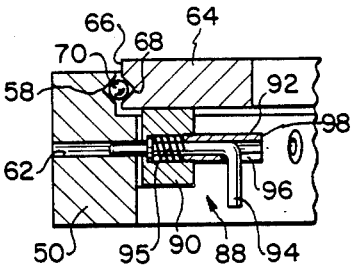
FIG. 5 is a cross-sectional view of the weapon support ring assembly taken along line 5—5 of FIG. 3 illustrating the traversing pin.

The weapon support ring assembly 20 is mounted to the pivotal weapon frame 18 through pivot mounts 46 on either side of the assembly 20 and a pivot mount 48 on the front of the assembly 20. Pivot mounts 46 and 48 are rigidly secured to a stationary ring 50. As best seen in FIGS. 4 and 5, the upper interior of the stationary ring 50 has a notch formed in it which defines a cylindrical interior surface 54 and an annular lip 56. A ball race 58 is formed in the cylindrical surface 54 as best seen in FIGURE 4. The inner surface 60 below the lip 56 has a plurality of radially extending holes 62.

Movable ring 64 nests within the notch as best seen in FIGS. 4 and 5. The outer cylindrical surface 66 of the movable ring 64 has a ball race 68. When the ring 64 is nested within the stationary ring 50, the surfaces 66 and 54 are facing each other. Individual ball bearings 70 can be inserted between the surfaces to run in the ball races 58 and 68 to support the movable ring 64 on the stationary ring 50 for free rotation relative thereto.

Mounting blocks 72 are secured at one position on the movable ring 64 and the blocks 72 and ring 64 define a cylindrical aperture 74. The machine gun 16 is pivotally supported with a bracket 76. The bracket includes a pintle 78 which is received within the cylindrical aperture 74 to secure the gun to the weapon support assembly 20. The bracket 76 includes a portion 80 which is secured to the gun and is provided with a tongue 82 having two apertures 84. The apertures 84 can be aligned with aperture 86 in bracket 76 to permit a pin 85 to be inserted through an aperture and lock the gun in a particular tilted orientation relative to the support ring assembly 20. In one position as seen in FIG. 3, the gun can be locked horizontally when the pivotal weapon frame 18 is in the firing position. In the other position, when the aperture 84 shown in FIG. 3 and aperture 86 are aligned, the gun can be fixed in a tilted upward position to permit the gun to clear the roof opening when the gun and pivotal weapon frame 18 are moved to the storage position.

An traversing pin assembly 88 depends from the movable ring 64 at a position slightly spaced around the ring from the blocks 72. The position is selected so that the operator of the gun 16, while standing behind the gun, can readily move his left arm and hand to operate the traversing pin assembly 88. The assembly 88 includes a block 90 which supports a hollow cylindrical member 92. One leg of an L shaped traversing pin 94 extends through the center of the member 92 and through a hole in the block 90 for insertion within one of the holes 62 in the stationary ring 50. The traversing pin 94 is preferably spring loaded by a spring 95 into a hole 62. The side of the member 92 exposed to the gunner has a slot 96 running along one side which permits the traversing pin 94 to lock into a hole 62 with the traversing pin 94 bottomed in the slot 96 as seen in solid line in FIG. 5. This will lock the movable ring 64 relative to the stationary ring 50 to form a more stable gun platform. Of course, the gun 16 can still be traversed by pivoting the pintle 78 within the cylindrical aperture 74. However, for rapid movement of the gun about the horizon, the traversing pin 94 can simply be pulled out of the hole 62 against the spring force and twisted so that the pin 94 contacts the edge 98 of the member 92, freeing the movable ring 64 for rotation relative to the stationary ring 50. The gun and movable ring 64 can then be rapidly rotated through the ball bearings 70 to the desired location. Simply flipping the traversing pin 94 off the edge 98 will cause the pin 94 to be urged against the stationary ring 50 and into a hole 62 if the hole is properly positioned. If not, the movable ring 64 can simply be rotated a small amount either way until the pin 94 is aligned with a hole 62 to lock the movable ring.

The stationary support frame 22 includes two support members 100, each extending from one of the clevises 36 to intersect at a point proximate the roof of the vehicle just in front of the roof opening to form an A-frame with apex 102. A support member 104 is secured to the members 100 at the apex 102 and extends forward, between the driver and passenger, near the interior of the roof to the top of the windshield 12. The windshield 12 may be a special, bulletproof section of glass which is mounted within a special reinforced windshield frame 108. The windshield frame 108, in turn, is secured to the conventional windshield opening of the vehicle 10. The support member 104 is secured to the top of the windshield frame 108. Yet another support member 110 is secured to the support member 104 and the windshield frame and extends downward along the interior of the windshield to be fastened to the dashboard 112 of the vehicle 10. The stationary support frame 22 therefore forms a very rigid frame while being essentially concealed within the vehicle from the casual outside observer.

Figure 6:
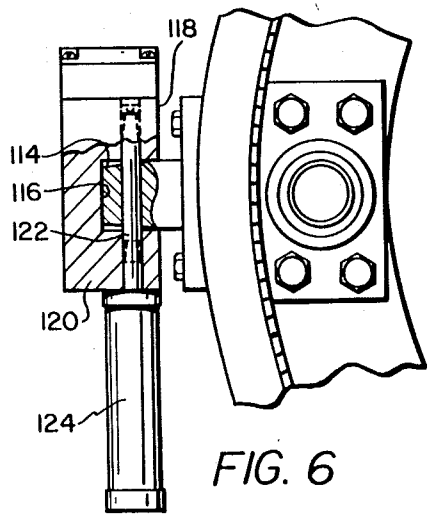
FIG. 6 is a cross-sectional view showing the indexing pin on the pivotal weapon frame received in the receptacle in the stationary support frame and locked therein by the locking pin.

As best seen in FIGS. 4 and 6, the front of the stationary ring 50 mounts an indexing pin 114. The indexing pin has a through aperture 116. When the pivotal weapon frame 18 is pivoted to the firing position, the indexing pin 114 is received within a receptacle 118 forming part of the stationary support frame 22 at the apex 102. The receptacle in essence defines a clevis 120. A locking pin 122 can pass through one side of the clevis 120, through the aperture 116 and through the other side of the clevis 120 to securely lock the weapon ring assembly and pivotal weapon frame to the stationary support frame 22. The locking pin 122 can be inserted and withdrawn by a double acting hydraulic cylinder 124 mounted on the stationary support frame 22 at the apex 102.

Figure 7:
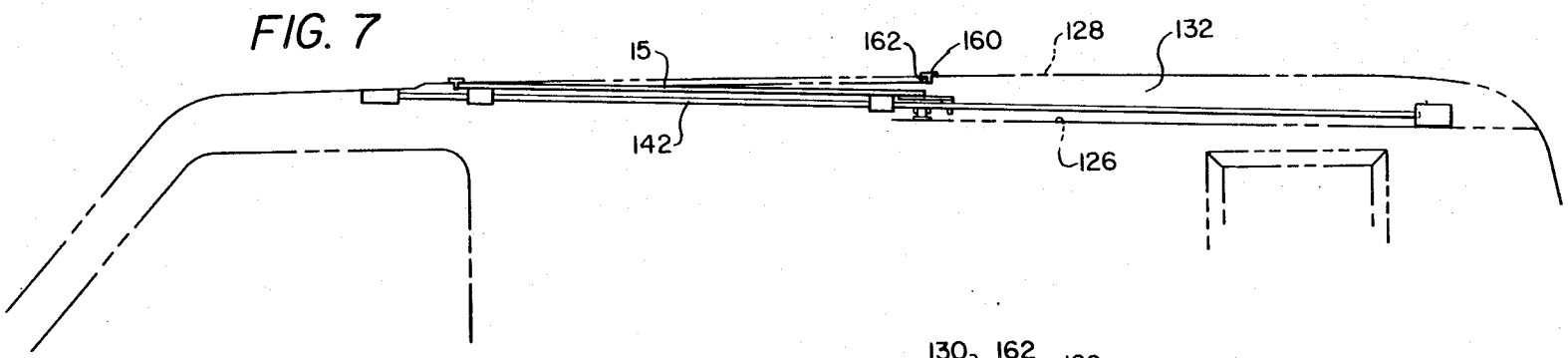
FIG. 7 is a cross-sectional view of the roof hatch assembly.

With reference now to FIGS. 7 and 8, the operation of the roof hatch 15 will be described. It can be seen that the roof of the vehicle 10 comprises an inner armored roof section 126 and an outer conventional roof section 128. The outer conventional section 128 has the external appearance of a conventional vehicle roof. The roof opening 130 through which the gun 16 is raised for firing is formed through both sections 126 and 128. However, it can be seen that rearward of the roof opening 130 between the sections 126 and 128 is formed a low space 132. The roof hatch is retracted into the space 132 before the weapon is raised for firing.

The roof hatch 15 may be constructed of an armor plate having a contour to fit in with the external contour of the conventional section 128 when the roof hatch 15 is positioned to close the roof opening 130 as seen in FIG. 1. Four parallel hinges 134 are mounted on the underside of the roof hatch 15 at each corner. As can be seen in the drawings, the parallel hinges comprise three plates 136, 138 and 140 with the plate 138 pivoted to one of the other plates at each end. Plates 136 and 140 of each hinge is rigidly secured to the roof hatch 15.

Parallel guide rods 142 are rigidly mounted to the armored roof section 126 and are disposed on either side of the roof opening 130. The guide rods 142 extend deep into the space 132 and slope downwardly from proximate the front of the roof opening 130 relative to the slope of the conventional roof section 128. Reciprocating ball support bearings 144 are secured to the plates 140 of the hinges 134 and are slidable along the guide rods 142 so that the roof hatch is not only supported by the guide rods 142 but permitted to move along the guide rods with minimum friction. The bearings 144 are conventional, and can be purchased from well-known bearing manufacturers, such as SKF.

A rotary screw 146 is mounted for rotation about an axis parallel the guide rods 142 through bearings 148 secured to the armored roof section 126. The rotary screw 146 can be rotated in either direction by a reversible electric motor 150 located at the rear of the vehicle and secured to the end of the rotary screw 146 most distant from the roof opening 130. A bracket assembly 152 is secured between the roof hatch 15 and the rotary screw 146 so that rotation of the rotary screw will move the roof hatch 15 between a position closing the roof opening 130 and the retracted position. The bracket assembly 152 includes a bracket 154 rigidly mounted on the lower side of the roof hatch 15 near the middle of its back end. A traversing member 156 is provided with internal threads which engage the threads on the rotary screw 146. A lifting link 158 is pivoted at one end to the bracket 154 and at the other end to the traversing member 156. A spring 159 preferably acts between the bracket 154 and lifting link 158 to urge bracket 154 and thus the rear of roof hatch 15 toward the guide rods 142.

Figure 8A:
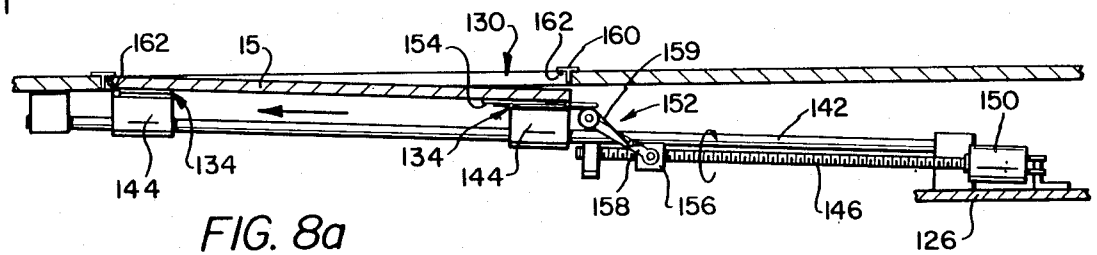
FIGS. 8*a* and 8*b* illustrate the movement of the roof hatch between the retracted position and the position closing the opening in the roof.
Figure 8B:
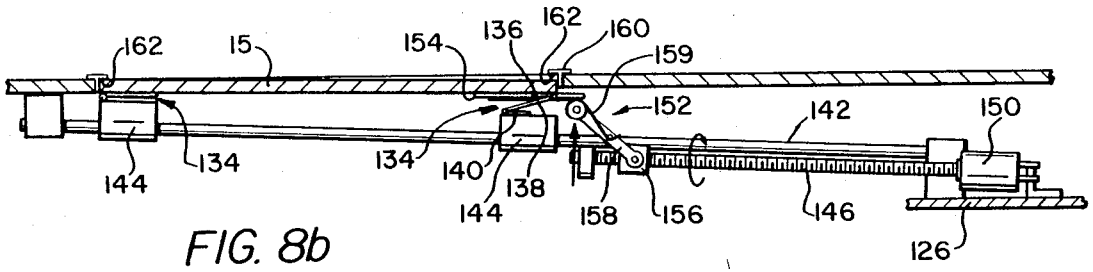

Assuming the roof hatch 15 is in the retracted position within the space 132, the roof can be moved to close the roof opening by driving the rotary screw 146 in one direction as shown in FIGS. 8*a* and 8*b* with electric motor 150 to move the traversing member 156 toward the roof opening. As the traversing member 156 moves toward the opening, it pushes the roof hatch toward the opening through the lifting link 158 and bracket 154. When the front of the roof hatch 15 contacts the front of the roof opening on the outer conventional roof section 128 as seen in FIG. 8*b*, further forward motion of the roof hatch 15 is prevented. However, the traversing member 156 is still moving toward the roof opening through the action of the rotary screw 146. This causes the lifting link 158 to pivot about bracket 154 and traversing member 156 against the weight of roof hatch 15 and the force of spring 159 to lift up the back end of the roof hatch to close the roof opening 130 through the conventional section 128 by causing the exterior of the roof hatch 15 to be flush with the exterior of the conventional roof section 128. In the preferred embodiment, a seal lip 160 is provided with a seal 162 which is compressed between the top outer lip of the roof hatch 15 and the lip 160 to prevent rain and debris from entering the interior of the vehicle when the roof hatch 15 is in the position shown in FIG. 1.

When the roof hatch 15 is to be retracted, the rotary screw 146 is rotated in the opposite direction, causing the traversing member 156 to move away from the roof opening and pivot the lifting link 158 with assistance from the weight of roof hatch 15 and the force of spring 159 to lower the back end of the roof hatch to clear the seal lip 160. Further rotation of the rotary screw will simply cause the roof hatch to slide along the guide rods into its retracted position in space 132 and permit the gun 16 to be elevated to the firing position. It will be noted that the parallel hinges 134 permit a slight vertical movement of the roof hatch relative to the guide rods to permit the roof hatch to essentially be lifted into the roof opening 130. While the weight of the roof hatch 15 alone may be adequate to prevent the lifting link from lifting the back end of the roof hatch until the front of the roof hatch contacts the front of the opening, a spring is preferably installed in the bracket assembly 152 as needed to overcome friction forces between hatch 15 and the guide rods that could cause the hatch 15 to lift and jamb within space 132 to assure smooth operation of the roof hatch.

Figure 9A:
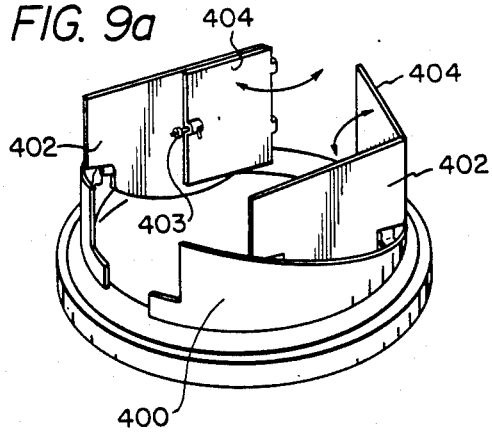
FIGS. 9*a* and 9*b* illustrate the armor mounted on the weapon support ring assembly for protecting the gunner.
Figure 9B:
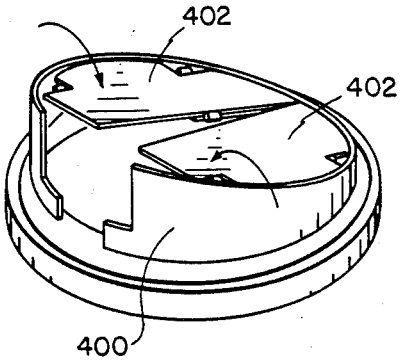

With reference to FIGS. 9*a* and 9*b*, armour is shown for use with gun 16 and ring assembly 20. The armour includes a fixed armour shield 400 permanently mounted on moveable ring 64. Two pivotal side shields 402 are pivotally secured to shield 400 and can be pivoted to the up position shown in FIG. 9*a* to protect the gunner, and pivoted to a storage position shown in FIG. 9*b*. A half rear shield 404 is hinged at the back edge of each side shield 402 to protect the gunner's back. When the armor is up, a clamp 403 secures the rear shields 404 together to hold up the shields 402 and 404. When stored, clamp 403 and a similar clamp (not shown) on the opposite side of shield 402 will secure the rear shields along the inside of the side shields.

Figure 10:
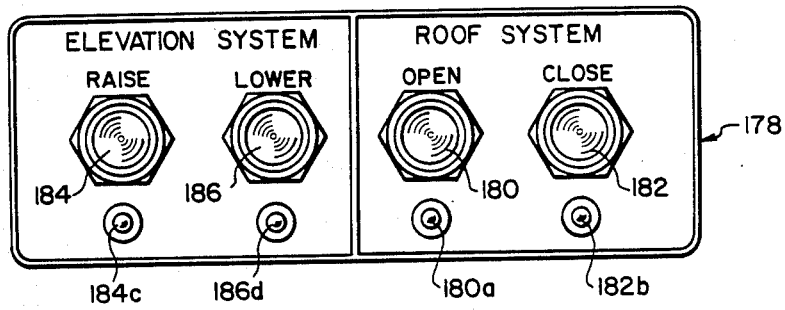
FIG. 10 illustrates the control panel for moving the roof hatch and pivoting the weapon between the storage and firing positions.
Figure 11:
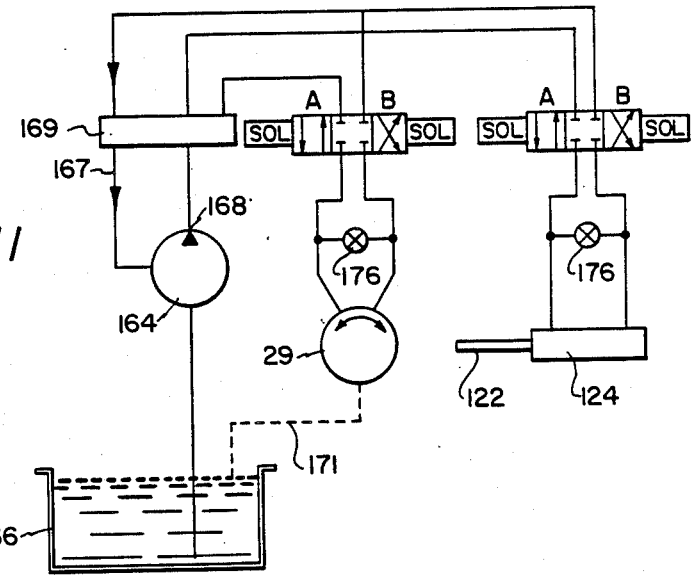
FIG. 11 illustrates the schematic of the hydraulic control system in the present invention.
Figure 12:
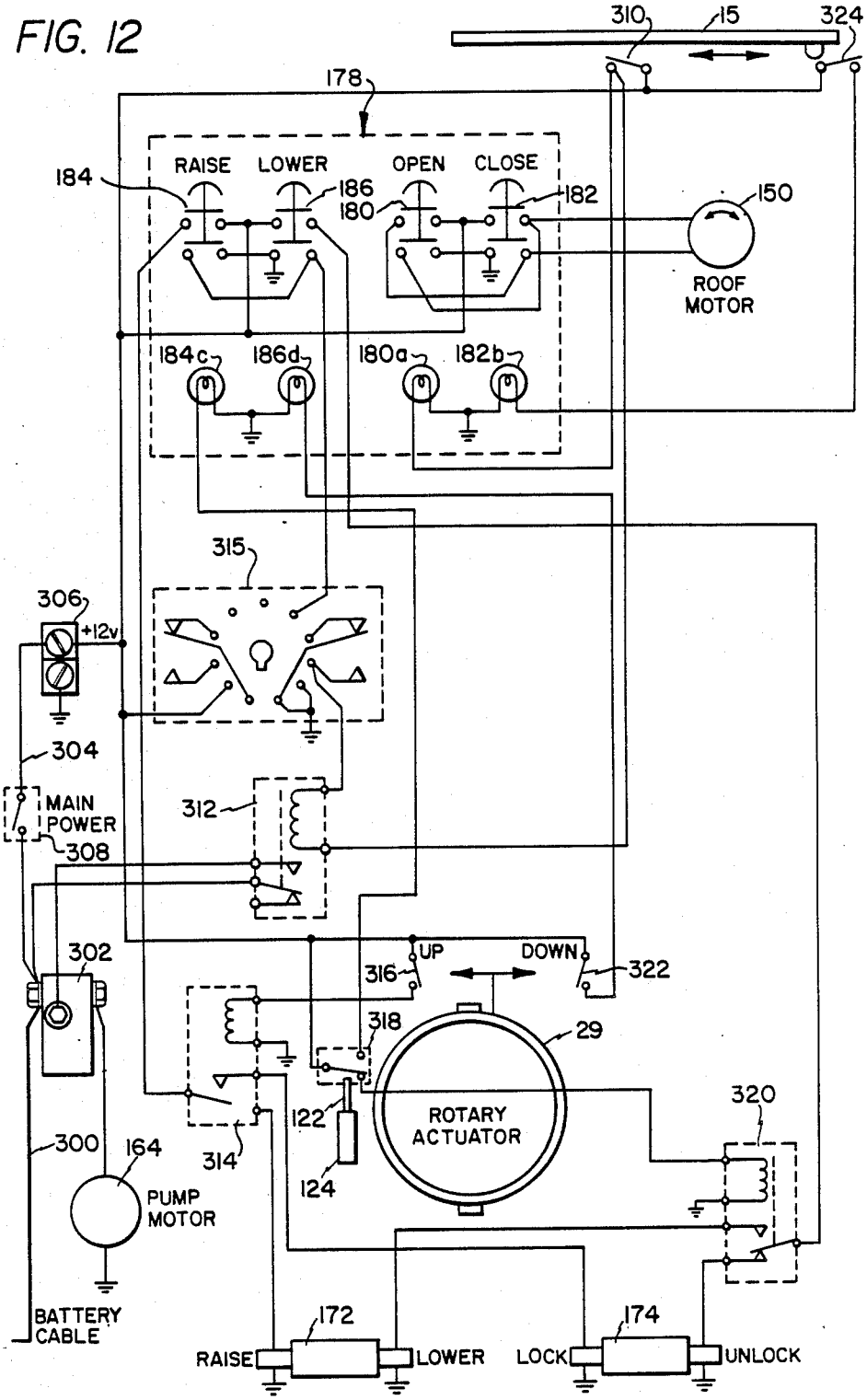
FIG. 12 illustrates the electrical schematic of the present invention.

With reference now to FIGS. 10, 11 and 12, the control system for the vehicle 10 is illustrated. With reference first to the hydraulic system illustrated in FIG. 11, a hydraulic pump 164 is provided which takes hydraulic fluid from the reservoir 166 and return line 167 and pressurizes the fluid at an outlet port 168. The hydraulic pump can be driven by any desired power source, such as the vehicle engine or an independent source such as an electric motor powered by a battery if the gun operation is to be completely separate from the engine of the vehicle 10.

The pressurized hydraulic fluid is passed through various hydraulic lines and a manifold 169 to a series of two solenoid operated hydraulic valves; weapon frame rotary actuator control valve 172 and locking pin control valve 174. Return lines extend from the valves to the manifold 169 and thus to line 167. A case drain 171 extends from the case of actuator 29 to reservoir 166 to drain fluid leaking into the case. As can be seen, each control valve 172 and 174 has three positions, position A, position B and a neutral position.

With reference to control valve 172, in position A, pressurized hydraulic fluid will be provided to hydraulic rotary actuator 29 to pivot the pivotal weapon frame 118, assembly 20 and gun 16 into the firing position. When the control valve 172 is moved to position B, pressurized hydraulic fluid causes the actuator 29 to move the frame 18, assembly 20 and gun 16 to the storage position. In the neutral position, motion of the frame, assembly and gun is prevented.

When the control valve 174 is in position A, the double acting hydraulic cylinder 124 will move the locking pin 122 through the clevis 120 and aperture 116 to lock the frame 18 to the frame 22. When in position B, the locking pin will be retracted, permitting the frame 18 to move away from the frame 22. When the valve 174 is in the neutral position, the locking pin will be immobile. If desired, valves, such as valves 176 can be positioned between the two hydraulic lines into actuator 29 and cylinder 124 which can be opened to permit manual operation of frame 18 or locking pin 122 if the hydraulic system fails. In fact, the electric motor 150 will typically have a nut shaped end directly connected to the rotary screw 146 so that a conventional battery powered electric hand drill, with the appropriate socket, can be used to manually move the roof hatch 15 in an emergency.

With reference to FIG. 10, the control panel 178 is illustrated. To simplify operation, the control panel only has four buttons, 180, 182, 184 and 186. Button 180 controls the movement of the roof hatch into the retracted position. Button 182 causes the roof hatch to move to the position closing the roof opening 130. Button 184 causes the frame 18, assembly 20 and gun 16 to be moved into the firing position and the locking pin to be engaged with the clevis 120 and traversing pin 114. Button 186 causes the locking pin 122 to be retracted and the frame 18, assembly 20 and gun 16 to be pivoted downward inside the vehicle to the storage position. Individual lights 180*a*, 182*b*, 184*c* and 186*d* correspond to the buttons and indicate when the desired function of the button is completed.

With reference now to FIG. 12, the electrical schematic of the invention is described.

Power is provided to the system by a power cable 300 from the vehicle battery or other power source to the inlet of a solenoid 302. The solenoid 302 can be of the type found on the starter motor of most vehicles. A power cable 304 extends from the power cable 300 at the solenoid 302 to one terminal of a bus bar 306. The other terminal of the bus bar is grounded as shown. A main power switch 308 can be incorporated in the power cable 304 to deactivate the systems power through the bus bar if the vehicle is to be out of use for a period of time.

As can be seen, the control panel 178 is powered through the bus bar 306. To initiate operation of the weapon system, the button 180 is depressed to move the roof hatch 15 into the retracted position. The button 180 must be pressed continuously for the roof to move. If the button is let up, the roof stops in the position the roof is moved to. Pushing the button 180 causes power to be applied to the roof motor 150 to rotate the motor in a direction to move the hatch into the retracted position. When the hatch has reached the fully retracted position, a microswitch 310 is activated by the roof hatch 15 which provides power from the bus bar to the light 180*a*, which indicates that the roof hatch 15 has been retracted. Closing of the microswitch 310 also provides a voltage to the coil within the power relay 312 which controls the movement of the pivotal weapon frame 18. However, the coil in relay 312 is not energized until either button 184 or 186 is pushed and timer relay 315 permits the coil to be grounded. Therefore, movement of the pivotal weapon frame 18 is prevented unless the roof hatch 15 is in the retracted position and has closed the microswitch 310.

To raise the weapon, the button 184 is depressed to activate the rotary actuator 29 and to move the pivotal weapon frame 18 to the firing position. When the button 184 is depressed, power is provided from the bus bar 306 to a relay 314 and the coil in relay 312 is grounded and energized. When the coil in relay 312 is energized, the relay 312 activates solenoid 302 to provide power to pump 164, which is preferably electrically driven. The pump 164 thus pressures the hydraulic fluid. Timer relay 315 can be employed to deactivate the coil of relay 312 and stop pump 164 after a predetermined time period of continuous running to avoid pump motor damage. After a time interval adequate to cool the pump motor, relay 315 resets to allow further use of the pump Motor. The coil in the relay 314 is only activated when the frame 18 is in the firing position. Therefore, when button 184 is depressed when frame 18 is not in the firing position, power will be provided through relay 314 to move the control valve 172 to position A to operate the rotary actuator 29 and move the pivotal weapon frame 18 to the firing position. The frame 18 will pivot as long as the button 184 is held down.

When the frame 18 has been pivoted to the firing position, the frame 18 will activate a microswitch 316 which provides power to the coil in relay 314 from the bus bar. While microswitch 316 is seen to be actuated by rotary actuator 29, the microswitch can be mounted in receptacle 118 for actuation by indexing pin 114 when it enters receptacle 118. This activates the coil and causes power to be provided to control valve 174 to move the control valve 174 into position A to lock the frame 18 to the stationary frame 22 with the locking pin 122.

When the locking pin 122 has locked frame 18 to frame 22, a microswitch 318 is activated to provide power from the bus bar to the light 184*c* to indicate that the frame 18 has been moved to the firing position and locked therein and also deactivates a normally activated coil in a relay 320.

When the gun is to be lowered, the button 186 is depressed. Power is then provided from the bus bar to the relay 320 which, when deactivated, causes the control valve 174 to move to position B to retract the locking pin 122. When the locking pin 122 is retracted, microswitch 318 reverts to its conventional position, energizing the coil in relay 320 from the bus bar. With the coil in relay 320 energized, the power passing through button 186 is provided to the control valve 172 which is moved to position B. In position B, the rotary actuator 29 moves the gun and frame 18 to the storage position. As the frame 18 moves to the storage position, it activates a microswitch 322 which lights light 186*d* to indicate that the gun has been moved to the storage position. While microswitch 322 is shown activated by rotary actuator 29, the microswitch 322 can be mounted on stop 44 for actuation by front leg 42 when it rests on stop 44 in the storage position.

Pushing the button 182 then provides power from the bus bar to the electric motor 150 to move the roof hatch 15 to the position closing the roof opening. When the roof hatch 15 has moved to close the roof opening, a microswitch 324 is activated which provides power from the bus bar to the light 182*b* to indicate that the roof hatch has closed.

It will be understood that while the roof hatch opening and closing mechanism has been shown for use on an armored vehicle with a concealed weapon, the mechanism can be used for any application where such a mechanism would be useful, such as a troup carrier, etc. The roof hatch 15 need not be armored, and other structure besides an inner armored roof can be used to support the mechanism.

Although a single embodiment of the invention has been illustrated in the accompanying Drawings and described in the foregoing Detailed Description, it will be understood that the invention is not limited to the embodiment disclosed, but is capable of numerous rearrangements, modifications and substitutions of parts and elements without departing from the spirit of the invention.

I claim:

1. A weapon system for a vehicle including an interior platform and having a roof with an opening therethrough, comprising:

a pivotal weapon frame pivotally attached to the interior platform for pivotal motion between a storage position and a firing position;

a weapon support ring assembly pivotally secured to the pivotal weapon frame so that the weapon support ring assembly is horizontal and positioned within the roof opening when the pivotal weapon frame is pivoted to the firing position, said pivotal weapon frame including a front leg pivotally mounted to the interior platform at a first end and to the front of the weapon support ring at the opposite end and two rear legs pivotally mounted to the interior platform at first ends and to each side of the weapon support ring at their opposite ends, the pivotal axes of said legs being parallel;

a roof hatch assembly for closing the opening through the roof of the vehicle to conceal the weapon and protect the interior of the vehicle, the vehicle having a conventional exterior roof having a normal appearance and an armored inner roof spaced therefrom, including:

(a) an armored roof hatch, the roof hatch having a contour so that it can close the opening through the roof;

(b) parallel guide rods mounted on the armored roof and extending along opposite sides of the roof opening, the parallel guide rods sloping downward from the roof hatch relative the conventional roof;

(c) means for supporting the roof hatch on the guide rods for movement along the guide rods and limited motion away from the guide rods;

(d) a bracket assembly including a lifting link pivotally secured at one end to the roof hatch and pivotally secured to a traversing member at the opposite end thereof; and (e) means for moving the traversing member along a direction parallel the guide rods to move the roof hatch between the closed position closing the roof opening and the retracted position, the bracket assembly causing a first end of the roof hatch to be lifted into the roof opening when the opposite end of the roof hatch contacts the edge of the roof opening by pivoting the lifting link relative to the roof hatch and traversing member, the bracket assembly further lowering the first end of the roof hatch when the roof hatch is moved to the retracted position by a pivotal motion of the lifting link relative to the roof hatch and traversing member to permit the roof hatch to move into the retracted position between the conventional roof and armored roof.

2. The weapon system of claim 1 wherein said means for connecting the roof hatch to the guide rods include a parallel hinge.

3. The weapon system of claim 1 further comprising control means for preventing the movement of the pivotal weapon frame to the firing position prior to fully retracting the roof hatch.

4. The weapon system of claim 1 wherein the weapon support ring assembly includes:

(a) a stationary ring mounted to the pivotal weapon frame;

(b) a movable ring nested within the stationary ring for rotation relative the stationary ring in a horizontal plane when the pivotal weapon frame is in the firing position;

(c) means for supporting the weapon on the movable ring; and (d) means for locking the movable ring relative to the stationary ring to provide a stable platform for the weapon.

5. The weapon system of claim 1 wherein said weapon support ring assembly further has an traversing pin, the vehicle further having a windshield mounted in an armored frame and a dashboard, a driver's seat and a passenger seat, the weapon system further comprising a stationary support frame including:

(a) first support members extending from the interior platform to a first position proximate the interior of the roof between the roof opening and the seats;

(b) a second support member extending generally horizontally from the first position proximate the interior of the roof to the top of the windshield frame;

(c) a structure defining an aperture secured to the support members at the first position for receiving the traversing pin of the pivotal weapon frame when in a firing position; and (d) means for locking the traversing pin within the aperture to provide enhanced support to the weapon.

6. A weapon system for a vehicle, the vehicle including an interior platform and a roof having a roof opening, comprising:

a pivotal weapon frame pivotally attached to the interior platform for pivotal motion between a storage position and a firing position;

a weapon support ring assembly including:

(a) a stationary ring mounted to the pivotal weapon frame so that the ring is horizontal and within the roof opening when the pivotal weapon frame is pivoted to the firing position, the stationary ring having an inner cylindrical surface with a ball race formed therein and an annular lip extending radially inward from the lower edge of the inner cylindrical surface;

(b) a movable ring for nesting within the stationary ring, the movable ring having an outer cylindrical surface with a ball race, the outer cylindrical surface of the movable ring facing the inner cylindrical surface of the stationary ring when nested therein;

(c) a plurality of ball bearings positioned between the rings, running in the races, to support the movable ring on the stationary ring and permit the movable ring to rotate freely relative to the stationary ring;

(d) means for supporting a weapon on the movable ring; and (e) a traversing pin mounted on the movable ring and operable between a locked position and an unlocked position, the stationary ring having a plurality of apertures formed therein distributed about the periphery of the stationary ring for receiving the traversing pin in the locked position to prevent movement of the movable ring relative to the stationary ring, movement of the traversing pin to the unlocked position permitting free rotation of the movable ring relative to the stationary ring;

a roof hatch assembly for closing the opening through the roof to conceal the weapon, pivotal weapon frame and weapon support ring assembly in the storage position, creating the illusion that the vehicle is a conventional vehicle.

7. The weapon system of claim 6 wherein the vehicle has a windshield mounted in an armored windshield frame and has a driver's seat and passenger seat immediately behind the windshield and in front of the roof opening, the weapon system further comprising a stationary support frame including:

(a) first support members extending upwardly from opposite sides of the interior platform to intersect at an apex near the interior of the roof proximate the roof opening to form an A-frame, and a second support member extending from the apex along the interior of the roof and secured to the top of the windshield frame;

(b) structure mounted at the apex defining a aperture, the weapon support ring assembly further comprising an traversing pin which is received in the aperture when the pivotal weapon frame is in the firing position; and (c) a locking pin which is slidable between an unlocked position, permitting free movement of the traversing pin within the cylindrical aperture, and a locked position where the locking pin passes through a portion of the structure and the traversing pin to rigidly secure the pivotal weapon frame to the stationary support frame to enhance the support of the weapon while the external appearance of the vehicle is conventional to the casual observer.

8. The weapon system of claim 6 wherein the roof is formed by a conventionally appearing exterior roof and an interior roof with a space between the roofs, the opening in the roof opening through both the conventional appearing roof and the interior roof, the roof hatch assembly including:

(a) a roof hatch for movement into the roof opening defined in the conventional appearing roof to close the roof opening and conceal the nature of the vehicle, the conventional roof having a lip at the roof opening extending into the roof opening and having a seal mounted on the lower edge of the lip for sealing contact with the upper exterior edges of the roof hatch to seal the roof hatch to the conventional roof;

(b) means to support the roof hatch for linear motion downward and away from the roof opening through the conventional roof for retracting the roof hatch into the space between the roofs;

(c) a plurality of parallel hinges supporting the roof hatch on said means for support to permit limited vertical movement of the roof hatch relative to the means for support;

(d) a rotary screw mounted on the interior roof for rotation about an axis parallel the direction of movement of the means for support;

(e) means for reversibly rotating the rotary screw;

(f) a bracket assembly including a traversing member with an internal thread engaging the rotary screw, a bracket mounted on the roof hatch and a lifting link pivoted between the bracket and the traversing member; and (g) rotation of the rotary screw when the roof hatch is in the retracted position in a first direction causing the traversing member, lifting link, bracket and roof hatch to move along said means for support until the forward edge of the roof hatch contacts the edge of the roof opening in the conventional roof, the cessation of further motion by the contact causing the lifting link to pivot about the bracket and traversing member to lift the rearward end of the roof hatch into the roof opening in the conventional roof to close the opening, rotation of the rotary screw in the opposite direction causing the lifting link to pivot relative to the bracket and traversing member to lower the rearward edge of the roof hatch and permit the roof hatch to move to the retracted position.

9. The weapon system of claim 6 further comprising control means for controlling the relative movement of the pivotal weapon frame and the roof hatch, the pivotal weapon frame being prevented from pivoting to the firing position until the roof hatch is in the retracted position.

10. A weapon system for a vehicle including an interior platform and a roof having a roof opening therethrough, comprising:

a pivotal weapon frame pivotally attached to the interior platform at three pivot positions, one of the pivot positions being elevated off the interior platform by a pedestal, the pivotal weapon frame being pivotal between a storage position and a firing position;

a weapon support ring assembly for supporting a weapon, including:

(a) a stationary ring mounted to the pivotal weapon frame so that the stationary frame is in the horizontal position in the roof opening when the pivotal weapon frame is in the firing position, the stationary ring having an inner cylindrical surface with a ball race formed therein and an annular rim extending radially inward from the lower edge of the inner cylindrical surface;

(b) a movable ring having an outer cylindrical surface with a ball race, the movable ring nesting within the stationary ring;

(c) a plurality of ball bearings positioned in the ball races between the rings to support the movable ring for rotation relative to the stationary ring;

(d) means on said movable ring for defining a cylindrical aperture;

(e) a mount for the weapon, the mount having a pintle for being received in the aperture in the movable ring for limited rotation, the mount further having a pivoting platform for supporting the weapon, the pivoting platform having at least two positioning apertures for alignment with a positioning aperture on the mount so that the weapon can be locked in the horizontal position when exposed through the roof opening of the vehicle and locked in a tilted storage position so that the weapon can be retracted to the storage position with the pivotal weapon frame without the weapon contacting the roof opening; and (f) a traversing pin mounted on the movable ring for movement between a locked position and an unlocked position, the traversing pin having an L shape, first leg of the traversing pin being adapted for movement into one of a plurality of holes formed about the inner periphery of the stationary ring to lock the movable ring relative the stationary ring, the second leg of the traversing pin being engagable with a surface on the movable ring with the first leg out of engagement of any aperture in the stationary ring to prevent free movement of the movable ring relative to the stationary ring;

a stationary support frame having first support members extending from the interior platform to intersect at an apex proximate the interior roof of the vehicle, a second support member extending from the apex toward the front of the vehicle for attachment to the vehicle proximate the top of the windshield, the support frame defining structure at the apex having a cylindrical aperture, an traversing pin being positioned on the stationary ring so that the traversing pin is received in the cylindrical aperture when the pivotal weapon frame is in the firing position, a locking pin for movement between an unlocked position and a locked position passing through the structure and the traversing pin to rigidly secure the pivotal weapon frame to the stationary support frame and means for activating the locking pin between the locked and unlocked positions;

a roof hatch assembly for closing the opening through the roof to conceal the weapon and protect the interior of the vehicle, the vehicle having an exterior roof of conventional appearance and an interior armored roof with a space between the roofs, the roof hatch assembly including:

(a) an armored roof hatch sized to close the opening through the conventional roof, the opening through the conventional roof having a lip with a seal positioned thereon for sealing against the roof hatch;

(b) parallel guide rods mounted on the armored roof and extending along opposite sides of the roof opening, the parallel guide rods sloping downward from the roof opening relative to the conventional roof;

(c) a parallel hinge mounted at each corner of the roof hatch on the underside thereof;

(d) means for supporting each of the parallel hinges and roof hatch on a guide rod for movement along the guide rod, two of the parallel hinges being supported on each of the guide rods;

(e) a rotary screw mounted on the armored roof between the roofs for rotation about an axis generally parallel the guide rods;

(f) means for reversibly rotating the rotary screw; and (g) a bracket assembly including a traversing member with an internal thread for engaging the threads on the rotary screw, a lifting link pivoted to the traversing member at a first end and to the roof hatch at the opposite end, rotation of the means for rotating the rotary screw causing the traversing member to move along the rotary screw, the traversing member moving the roof hatch along the guide rods through the lifting link between the retracted position and the position closing the roof opening through the conventional roof, the front of the roof hatch contacting the edge of the roof opening in the conventional roof so that further motion of the traversing member causes the lifting link to lift up the rear of the roof hatch to close the opening through the conventional roof, reverse rotation of the rotary screw causing the lifting link to lower the rear end of the roof hatch to permit the roof hatch to be retracted into the space between the roofs;

control means for controlling movement of the roof hatch and pivotal weapon frame including:

(a) means for activating said means for rotating a rotary screw to cause the roof hatch to move to the retracted position;

(b) means including a first microswitch for sensing movement of the roof hatch into the retracted position;

(c) means for pivoting the pivotal weapon frame from the storage position to the firing position and locking the traversing pin in the aperture of the stationary support frame with the locking pin only subsequent to the first microswitch sensing movement of the roof hatch to the retracted position; and (d) means for indicating movement of the locking pin to the locking position securing the traversing pin within the cylindrical aperture of the stationary support frame to indicate to the operator that firing of the weapon can safely commence.

11. The weapon system of claim 10 wherein said stationary ring further supports a ring of fixed armor and a plurality of armor panels which are mounted to the fixed armor for movement between a collapsed position when the weapon is stored within the vehicle to an extended position to protect the gunner when the weapon is ready for firing.

* * * * *